US010306742B2

(12) United States Patent
Sanders et al.

(10) Patent No.: US 10,306,742 B2
(45) Date of Patent: May 28, 2019

(54) DROPLET DISPENSING DEVICE, METHOD FOR PROVIDING DROPLETS, AND LIGHT SOURCE FOR PROVIDING UV OR X-RAY LIGHT

(71) Applicant: ETH Zurich, Zurich (CH)

(72) Inventors: Alexander Sanders, Zürich (CH); Bob Rollinger, San Diego, CA (US); Reza Abhari, Forch (CH)

(73) Assignee: ETH Zurich, Zurich (CH)

( * ) Notice: Subject to any disclaimer, the term of this patent is extended or adjusted under 35 U.S.C. 154(b) by 0 days.

(21) Appl. No.: 15/592,273

(22) Filed: May 11, 2017

(65) Prior Publication Data

US 2017/0332467 A1 Nov. 16, 2017

(30) Foreign Application Priority Data

May 11, 2016 (EP) ..... 16169161

(51) Int. Cl.

| | |
|---|---|
| ***H05G 2/00*** | (2006.01) |
| ***B05B 1/08*** | (2006.01) |
| ***B05B 15/40*** | (2018.01) |

(52) U.S. Cl.

CPC ..... *H05G 2/006* (2013.01); *B05B 1/083* (2013.01); *B05B 15/40* (2018.02); *H05G 2/005* (2013.01); *H05G 2/008* (2013.01)

(58) Field of Classification Search

USPC ..... 250/504 R

See application file for complete search history.

(56) References Cited

U.S. PATENT DOCUMENTS 5,460,199 A * 10/1995 Takata ..... B60T 8/3265 137/504

7,872,245 B2 * 1/2011 Vaschenko ..... H05G 2/003 156/345.24

FOREIGN PATENT DOCUMENTS

| | | |
|---|---|---|
| EP | 0265924 | 5/1988 |
| WO | WO2012136343 | 10/2012 |

* cited by examiner

*Primary Examiner* — Phillip A Johnston

(74) *Attorney, Agent, or Firm* — Soroker Agmon Nordman

(57) ABSTRACT

The invention relates to a droplet dispensing device (4) comprising a reservoir (9) for containing a liquid medium (10), an outlet (11) for dispensing droplets of said liquid medium (10) from said reservoir (9), an actuation means (12) for generating and transmitting a mechanical oscillation at an excitation frequency, and a resonant structure comprising a piston (15) coupled to said actuation means (12) for transmitting said mechanical oscillation to the liquid medium (10) contained in said reservoir (9) such that droplets are formed from said liquid medium (10), wherein a resonance frequency of said resonant structure is sufficiently close to said excitation frequency, such that resonance occurs.

The invention further relates to a UV or X-ray light source, comprising a droplet dispensing device (4) according to the invention, and a method for providing a stream, in particular a monodisperse stream, of droplets by means of the droplet dispensing device (4).

14 Claims, 4 Drawing Sheets

DROPLET DISPENSING DEVICE, METHOD FOR PROVIDING DROPLETS, AND LIGHT SOURCE FOR PROVIDING UV OR X-RAY LIGHT

The invention relates to a droplet dispensing device for providing droplets, in particular a monodisperse stream of droplets, a method for providing droplets, in particular a monodisperse stream of droplets, by means of the device according to the invention, and a light source for providing UV or X-ray light using droplets produced by means of a droplet dispensing device according to the invention. In particular, the droplets are formed from a molten metal, for example tin.

Droplet dispensing devices are used for example in extreme ultraviolet (EUV) light sources. Therein, droplets of a target material—such as molten tin droplets—are irradiated by a high powered laser to create a highly ionized plasma state which emits radiation in the EUV range due to the recombination and de-excitation of the ions and EUV light is emitted from the plasma. Extreme ultraviolet light can be used in lithography processes involved in the production of semiconductors and offers a reduction of the achievable pattern size due to its small wavelength and the resulting high-resolution capability. Further applications include high-resolution microscopy, mask and pattern inspection. In addition, metal droplets in the micrometer size range can also be used for 3D metal printing, and droplet dispensing devices can be used to obtain such droplets.

For example, droplet dispensing devices of the prior art comprise a reservoir containing molten metal and an oscillating mechanical structure which is in contact with the molten metal, thereby generating acoustic waves in the molten metal which leads to formation of droplets at an outlet of the reservoir.

Document U.S. Pat. No. 5,598,200 A describes a system for the drop-on-demand generation of molten metal droplets by traversing a piston immersed in the liquid, the tip of which displaces fluid close to the nozzle leading to the periodic ejection of droplets out of the nozzle orifice (see also U.S. Pat. No. 8,523,331 B2).

Moreover, document U.S. Pat. No. 6,491,737 B2 describes an actuation system for the continuous generation of metallic microspheres. It employs a piston that one side of which is actuated by a piezoelectric actuator while the other side immersed in the liquid where it generates acoustic pressure waves leading to the break-up of the jet emanating a nozzle orifice (see also documents U.S. Pat. Nos. 6,520,402 B2, 6,562,099 B2 and 7,029,624 B2).

A method to produce molten metal droplets employing an actuation system based on the interaction of a sheathing gas flow with the jet is presented in Microfluid Nanofluid, January 2012, Volume 12, Issue 1, pp. 75-84. It is shown to produce a low frequency (>120 Hz) droplet stream. Similarly, a method to produce molten metal droplets based on pneumatic pressure pulses is presented in Manufacturing Engineering Society International Conference 2015, Vol. 132, pp. 110-117.

Furthermore, the article "Formation of uniformly sized metal droplets from a capillary jet by electromagnetic force" by Shimasaki et al. (2011) describes a method that leads to the break-up of a molten metal jet by exposing it to an intermittent electromagnetic pinch force.

Document U.S. Pat. No. 7,897,947 B2 and document U.S. Pat. No. 8,969,839 B2 describe EUV light sources including a droplet generator consisting of a reservoir of molten metal and a capillary to which a piezoelectric actuator is attached and which excites the jet in order to achieve stable droplet break-up. Amplitude or frequency modulated excitation signals can be applied to the piezoelectric actuator in order to achieve droplet merging (see also U.S. Pat. No. 7,872,245 B2). Specifically, document U.S. Pat. No. 8,969,839 B2 describes the theoretical tuning of the concentric excitation system to match the desired frequency of the droplet generation.

Furthermore, document U.S. Pat. No. 8,816,305 B2 discloses an apparatus for supplying target material of an EUV light source to the target location including a source material handling system and means to filter out impurities of the target material to prevent clogging of the nozzle orifice (see also U.S. Pat. No. 8,890,099 B2).

The droplet dispensing devices known so far have the disadvantage that the droplet size (sizes larger than 50 μm, and/or an inhomogeneous droplet size) and in particular the temporal stability (referring to the standard deviation of the time of flight between subsequent drops) of the droplet stream are not accurate enough for the stable and efficient generation of extreme ultra-violet or soft x-ray radiation for a laser-produced plasma light source.

This applies in particular to the generation of high velocity micrometer sized droplets associated with a low non-dimensional wave numbers, which is of crucial importance for EUV light sources. In order to improve these characteristics, the amplitude of the oscillation can be increased resulting in higher pressure acoustic waves in the molten metal, but this requires complex oscillation devices.

In the cases where resonant structures are utilized in devices of the prior art, resonance frequencies higher than 250 kHz are reported (see U.S. Pat. No. 8,969,839 B2), a frequency too high for the efficient operation of an EUV light source.

Furthermore, droplet dispensing devices intended for the operation at one of their resonant frequencies known so far are based on electro-actuatable elements either attached directly to the nozzle region and are thus exposed to a high heat load, thus decreasing the service life, or electro-actuatable elements attached outside of the reservoir, which makes it difficult to design devices with predictable resonance frequencies. Therefore, it is an objective of the present invention to provide a droplet dispensing device, and a method of producing droplets, which are improved in relation to the above-stated disadvantages of the prior art. In particular, it is an objective of the present invention to provide a droplet dispensing device which is able to generate a droplet stream of high temporal stability, wherein the droplets have a homogeneous size distribution.

Furthermore, in particular, it is an objective of the invention, to create a droplet dispensing device with improved temporal stability and precision of the droplet size, even when the liquid used is a high temperature molten metal, the droplets are in the micrometer range (1 μm to 50 μm), the frequency in the range of 1 kHz to 1000 kHz and even when the non-dimensional wavenumber is less than 0.3.

This objective is attained by the subject matter of the Independent claims relating to a droplets dispensing device, a light source comprising the droplet dispensing device, and a method for producing droplets. Favorable embodiments of the device and method are further claimed as dependent claims. The invention is described hereafter.

A first aspect of the invention relates to a droplet dispensing device comprising a reservoir for containing or receiving a liquid medium, wherein the droplet dispensing device comprises an outlet, particularly an outlet nozzle or outlet nozzle assembly, for dispensing droplets, particularly a stream of droplets, of the liquid medium from the reservoir, and an actuation means for generating and transmitting a mechanical oscillation and/or a periodic mechanical force at an excitation frequency, wherein the droplet dispensing device comprises a resonant structure, particularly an acoustically resonant structure, coupled to the actuation means and/or comprising the actuation means, wherein the resonant structure has a resonance frequency which is sufficiently close to the excitation frequency, such that resonance occurs when the mechanical oscillation and/or the periodic mechanical force is transmitted from the actuation means to the resonant structure and/or to the liquid medium at the excitation frequency, and wherein the actuation means and/or the resonant structure comprises a piston, wherein the piston comprises a tip, which is immersed or immersible in the liquid medium, wherein the piston is adapted to transmit the mechanical oscillation and/or periodic mechanical force from the actuation means to the liquid medium, in particular at the outlet, just upstream of the outlet or in the outlet nozzle assembly, such that droplets are formed from the liquid medium, wherein particularly pressure waves are induced in the liquid medium that lead to the break-up of a jet of the liquid medium into a regular stream of monodisperse droplets at a desired frequency, for example the excitation frequency and/or resonance frequency. That is, the resonant structure and the actuation means form an oscillation system.

In particular, the breakup of the stream of liquid medium can be caused by Rayleigh plateau instabilities (in this case the breakup can also be described as Rayleigh breakup) as a result of the induced pressure waves in the liquid medium or by another mechanism (e.g. the active displacement of the liquid medium but not limited to this) or a combination thereof.

Findings in the literature state that there exists a certain range around the optimum non-dimensional wavenumber around which stable monodisperse jet break-up can be achieved. "Drop formation from a vibrating orifice generator driven by modulated electrical signals" (G. Brenn and U. Lackmeler, Physics of Fluids 9, 1997) states a lower limit of k*=0.3 for monodisperse droplet formation. A similar value is presented by M. Rohani in "Breakup control of a liquid jet by disturbance manipulation" (Physics of Fluids 22, 2010).

Therein, the non-dimensional wavenumber k* is defined as:

$$k^* = \frac{2\pi a}{\lambda} = \frac{2\pi a f}{v}$$

with a being the jet radius, A the wavelength, f the excitation frequency and v the jet velocity.

However, it was surprisingly found that monodisperse jet break-up can be achieved even at non-dimensional wave number below 0.3 using the droplet dispensing device comprising the resonant structure according to the invention.

The piston is coupled to a means for generating mechanical oscillations, for example an electro-actuatable element, and is thus part of the structure inducing the pressure waves in the liquid medium, in other words, the actuating means. At the same time, the piston is part of the resonant structure, meaning the piston is designed such that it resonates at the desired resonance frequency when the mechanical oscillations are generated by the actuating means.

In particular, the piston extends along a longitudinal axis, and the width of the piston perpendicular to the longitudinal axis is small compared to the length of the piston along the longitudinal axis, in particular at the tip of the piston immersed or immersible in the liquid medium. For example, the width of the piston may be less than 10% of the length.

In particular, the piston s adapted to generate longitudinal pressure waves in the liquid medium, in other words waves propagating along the longitudinal axis, along which the piston extends. Furthermore, in particular, the pressure waves are generated at or near the tip of the piston immersed or immersible in the liquid medium.

Using a piston, which is a part of a resonant structure, in order to induce the pressure waves in the liquid medium has the advantage that the resonance frequency of the resonant structure can easily be predicted, designed and/or tuned. For example, when the width of the piston is small compared to the length of the piston, the resulting acoustic resonance frequency of the piston can be calculated using known methods when the length of the piston and the sound velocity of the piston material are known.

Furthermore, the piston has the advantage that the actuation means can be spatially separated from the hot liquid in the reservoir, which is beneficial for the generation of droplets from a high temperature liquid including molten metals with a high melting point.

In addition to the piston, the resonant structure may contain additional components, such as a backing mass attachment, a casing of the droplet dispensing device, the liquid reservoir and/or the liquid contained in the reservoir. In particular, the resonant structure can be designed such that the resonance frequency of the resonant system is mainly determined by the piston length and material. Such additional components influencing the resonance frequency of the resonant structure can be taken into account in the calculations of the resonance frequency using known methods.

In the context of the present specification, the term 'backing mass attachment' describes a structure which is mechanically coupled to the piston, such that the backing mass attachment influences the resonance frequency of the resonant structure. In particular, by selecting the mass, material, dimensions and coupling position, the resonant frequency can be advantageously tuned.

In particular, the actuation means further comprises an electro-actuatable element, particularly a piezoelectric element, and a backing mass attachment, wherein the piston, the electroactuatable element, and the backing mass attachment are mechanically connected, particularly wherein the dimensions of the piston, the electro-actuatable element and the backing mass attachment are chosen such that at certain excitation frequencies a standing wave and thus a resonant system is formed, such that the vibration displacement of the tip of the piston immersed in the liquid medium and the induced pressure waves in the liquid medium are maximized. In turn, this means that also the amplitude of the mechanical oscillation of the tip of the piston is maximized.

The resonant structure increases the vibration displacement (and the amplitude) of the induced pressure waves and thus advantageously improves the temporal stability (temporal stability referring to the standard deviation of the time of flight between subsequent droplets, also termed timing jitter) and size homogeneity of the obtained droplet stream (that is uniformly sized droplets). In particular for lithography and microscopy applications and for 3D metal printing a high temporal stability of the droplet stream is required. Further, by means of the resonant structure, the diameter of the droplets is reduced. Advantageously, droplets having a small size (1 μm to 50 μm diameter) reduce the so-called debris formation during extreme UV (EUV) light generation, as only a small fraction of the droplet gets converted into EUV-emitting plasma and the debris can reduce the lifetime of the various optical components inside the EUV light source required to refocus the EUV light emitted by the plasma.

In particular, according to the invention an actuation means is used to apply a disturbance on a jet emanating from an outlet that then breaks up into a stream of droplets at a frequency corresponding to the driving frequency of the disturbance.

The droplet dispensing device according to the invention may comprise a reservoir for receiving a liquid medium, an outlet nozzle having a nozzle orifice in fluid and acoustic communication with the reservoir and an actuation means acting on the liquid medium at the outlet nozzle to exit the outlet nozzle in a sequence of droplets. The actuation means may further be coupled to a piston, which is actuated by an electro-actuatable element being mounted in-between a backing mass attachment and the piston. The backing mass attachment, electro-actuatable element and piston may all be positioned on the same longitudinal axis.

In certain embodiments, the resonant structure comprises the reservoir and/or the liquid medium contained in the reservoir.

In one embodiment, the electro-actuatable element and the backing mass attachment are positioned outside of the reservoir, such that in particularly the electro-actuatable element is protected from the hot liquid medium in the reservoir. Alternatively, the electro-actuatable element and the backing mass attachment can also be positioned on the Inside of the reservoir. In particular, the free piston tip is immersed in the liquid medium just upstream of the outlet nozzle.

In certain embodiments, the droplet dispensing device comprises a reservoir for receiving a liquid medium, an outlet nozzle assembly in fluid communication with the reservoir, an actuation means based on a piston resonance structure, which is acting on the liquid medium emanating from the outlet nozzle assembly such that a regular monodisperse droplet stream is formed, wherein the actuation means comprises a piston, a backing mass attachment and an electro-actuatable element positioned outside of the reservoir and in-between the piston and the backing mass attachment.

In particular, the outlet nozzle assembly and the fluid (or liquid medium) inside it can also form part of the resonant structure in order to further amplify the strength of the pressure excitation at the nozzle orifice.

According to another embodiment, the droplet dispensing device is adapted to generate high amplitude excitation pressure waves in the liquid medium, such that a highly regular stream of droplets may be generated, in particular at operating conditions associated with a non-dimensional wavenumber below 0.3.

In particular, the reservoir is in fluid communication or can be brought into fluid communication with the outlet.

In certain embodiments, the reservoir is adapted to contain a molten metal or metal alloy, particularly aluminium, chromium, copper, nickel-chromium based alloys (such as alloys commercially available under the name "Inconel"), iron, magnesium, molybdenum, nickel, platinum, steel, tin, or titanium, more particularly tin.

In certain embodiments, the droplet dispensing device is able to withstand pressures up to 5000 bar and/or temperatures of up to 4000° C.

According to a further embodiment, the reservoir comprises a chemically inert material, particularly tungsten, silicon nitride, or a ceramic.

For example, the outlet nozzle can be made out of one piece into which the nozzle orifice is micro-machined. In particular, the outlet nozzle or outlet nozzle assembly can be adapted such that it can be easily replaced and exchanged. Therein, in particular micro-machining serves to achieve small orifice diameters (5 μm to 50 μm) and smooth surfaces on the inside of the nozzle orifice. For example, the micro-machining process can involve techniques such as laser drilling, etching or electrical discharge machining.

In certain embodiments, the outlet is an outlet nozzle assembly, wherein particularly the outlet nozzle assembly is made out of or comprises a chemically inert material, particularly tungsten, silicon nitride, or a ceramic.

In certain embodiments, the excitation frequency is in the range of 1 kHz to 1000 kHz, particularly 1 kHz to 200 kHz. Therein, the actuation means is adapted to generate oscillations, in particular acoustic waves, at the excitation frequency in the liquid contained in the reservoir. In particular, the reservoir is in fluid communication or can be brought into fluid communication with the outlet, such that a break-up of the liquid into droplets is achieved at the outlet.

In certain embodiments, the actuation means comprises an electro-actuatable element, particularly a piezoelectric element, which is adapted to transmit the mechanical oscillation to the piston.

In certain embodiments, the actuation means further comprises an electro-actuatable element, particularly a piezoelectric element, and a backing mass attachment, wherein the piston, the electro-actuatable element, and the backing mass attachment are mechanically connected, particularly wherein the dimensions of the piston, the electro-actuatable element and the backing mass attachment are chosen such that at certain excitation frequencies a standing wave and thus a resonant system is formed, such that the vibration displacement of the tip of the piston immersed in the liquid medium and the induced pressure waves in the liquid medium are maximized.

According to certain embodiments, the electro-actuatable element and/or the backing mass attachment is positioned outside of the reservoir. In certain embodiments, the piston and the backing mass attachment are mechanically connected to the electro-actuatable element, particularly wherein the electro-actuatable element is positioned in between the piston and the backing mass attachment.

Furthermore, according to certain embodiments, the backing mass attachment comprises at least two parts, wherein one of the at least two parts is mechanically connected to the electro-actuatable element, such that no rotary motion or torsional forces are imposed onto the electro-actuatable element.

Therein, in particular, the piston oscillates parallel to the longitudinal axis, such that a longitudinal wave is generated in the liquid medium.

As used herein, the term "electro-actuatable element" means a material or structure which undergoes a dimensional change when subjected to a voltage, electric field, magnetic field, or combinations thereof and includes, but is not limited to, piezoelectric materials, electrostrictive materials and magnetostrictive materials.

In certain embodiments, the droplet dispensing device is configured such that the tip of the piston contacts the liquid medium when the liquid medium is contained in the reservoir, wherein the mechanical oscillation can be transmitted to the liquid medium by means of the tip.

According to another embodiment, the piston and/or the reservoir is produced out of a material, which is inert to chemical reaction with molten tin, particularly tungsten, silicon nitride or a ceramic.

According to further embodiment of the invention, the electro-actuatable element is actively and directly cooled, for example via impingement air cooling or using an electrically non-conducting cooling fluid, in particular in case the electro-actuatable element s positioned outside of the reservoir.

In particular, when the reservoir contains the liquid medium, the tip of the piston is in direct contact with the liquid medium and the piston is actuated by the electro-actuatable element to which a voltage signal is applied such that the piston tip vibrates, inducing pressure waves in the liquid medium that lead to the break-up of a jet of the liquid into a regular stream of monodisperse droplets at a desired frequency.

In certain embodiments, the dimensions of the piston, the electro-actuatable element and the backing mass attachment are chosen such that at certain frequencies a standing wave and thus a resonant system is formed, such that the vibration displacement of the piston tip immersed in the liquid medium and the induced pressure waves in the liquid medium are maximized. If the piston, electro-actuatable element and the backing mass attachment form a resonant system, the piston tip forms a point of increased displacement at desired resonance frequencies. In addition to the aforementioned parts, the outlet nozzle assembly and the fluid inside it can also form part of the resonant structure in order to further amplify the strength of the pressure excitation at the nozzle orifice.

According to another embodiment of the invention, the piston tip is adapted to vibrate, thereby radiating acoustic pressure waves into and or inducing pressure waves in the liquid medium. The radiated acoustic pressure waves or the induced pressure waves or a combination of both may excite a jet emanating from the nozzle assembly and lead to the break-up of the jet into a stream, particularly a regular monodisperse stream, of droplets with high temporal stability.

In certain embodiments, the piston comprises at least a first section having a first cross-sectional area perpendicular to a longitudinal axis, along which the piston extends, and a second section having a second cross-sectional area, wherein the second cross-sectional area is larger or smaller than the first cross-sectional area, and wherein the second section is adapted to contact the liquid medium, wherein in particular the second section comprises the tip of the piston, such that the displacement (and also the amplitude of the mechanical oscillation) of the piston, particularly induced by the electro-actuatable element, can be amplified, wherein in particular the displacement of the piston tip immersed in the liquid medium and the induced pressure waves in the liquid medium are maximized.

In the context of the present specification, the term displacement is used to describe a periodic displacement caused by the vibrations (or mechanical oscillations) of the actuating means, wherein the displacement is a vibration displacement. Hence, in particular, when the displacement is amplified, the amplitude of the mechanical oscillation is also amplified.

In particular, the piston comprises a step change in cross-sectional area, more particularly a diameter step change, in particular such that the displacement of the piston induced by the electro-actuatable element can be amplified. Furthermore, the direction of the displacement is particularly along the longitudinal axis, along which the piston extends.

Therein, according to a first alternative, the cross-sectional area of the second section is smaller than the cross-sectional area of the first section. That is, the section having the smaller cross-sectional area, for example the smaller diameter, contacts the liquid medium and induces the pressure waves.

In certain embodiments, the piston comprises at least a first section having a first maximal diameter, and a second section having a second maximal diameter, wherein the second maximal diameter is smaller than the first maximal diameter, and wherein the second section is adapted to contact the liquid medium contained in the reservoir, particularly wherein the piston comprises a diameter step change such that the displacement of the piston, particularly induced by the electro-actuatable element, can be amplified.

In particular, the step change in diameter may be positioned in the centre of a nodal region of very low displacement at the resonant frequency such that the displacement of the piston tip can be amplified by a factor proportional to the change in cross sectional area of the piston above and below this step change. Advantageously, this can be used to maximize the strength of the pressure waves.

According to a second alternative, the cross-sectional area of the second section is larger than the cross-sectional area of the first section. That is, the section having the larger cross-sectional area, for example the larger diameter, contacts the liquid medium and induces the pressure waves. Although this configuration does not amplify the displacement of the piston tip in media with low acoustic impedance (e.g. air), this configuration can reduce the phenomenon of resonance suppression, in particular when the medium the piston tip is immersed in has a high acoustic impedance, and hence ensure the largest displacement of the piston tip for the given medium and the largest pressure waves induced in that given medium.

In certain embodiments, the piston is mechanically connected to a cover of the reservoir or on an inside wall of the reservoir, wherein the connection or attachment point between the piston and the cover or the inside wall forms a region of smaller displacement than the displacement of the tip of the piston, wherein particularly the displacement of the region of smaller displacement is less than 10%, more particularly less than 1%, compared to the displacement of the tip of the piston. In particular, said displacement refers to an excitation frequency in the range of 1 kHz to 200 kHz.

In particular, the region where the resonance structure is connected to the cover or to the walls of the reservoir of the droplet dispensing device can form a region of minimum displacement such that a minimum amount of vibrations is transferred into the cover and into the outside structure of the dispensing device such that a minimum amount of vibration is transferred into the medium other than through the piston tip. This has the effect that the vibration displacement of the piston tip immersed in the liquid medium is maximized, such that the induced pressure waves in the liquid medium are maximized. Furthermore, the region of minimum displacement has the advantage that the actuation means can be spatially separated from the hot liquid in the reservoir.

In certain embodiments, the piston is positioned on, particularly mechanically connected to a cover of the reservoir or on an inside wall of the reservoir, particularly wherein the cover and the piston are manufactured out of one piece, wherein the attachment point of the piston on the cover or on the inside wall forms a region of minimum displacement of the resonant structure.

Said connection, by which the piston is connected to the cover or inside wall may be a detachable connection, such that in particular pistons of different length, material and shape can be used as part of the actuating means/resonant structure. In this manner, a specific resonance frequency can be chosen for a respective application exchanging the piston.

In particular, the region of smaller displacement is a region of minimum displacement.

In particular, the cover and the piston are manufactured out of one piece.

According to another embodiment of the invention, the actuation means can be attached to the cover or to the inside walls of the reservoir, and the region of attachment forms a nodal region of insignificant displacement at the resonance frequency, while the piston tip exhibits significant displacement such that a minimum amount of vibrations is transferred into the cover and into the outside structure of the dispensing device. As a result a minimum amount of vibrations is transferred into the liquid medium other than through the piston tip. This ensures the generation of a single excitation signal being formed in the liquid, in order to reduce the undesired influence of noise sources on the droplet break-up. Therein, for example, the cover and the piston can be machined out of one piece.

In particular, the reservoir of the droplet dispensing device may comprise a cover that is detachable from a container forming the reservoir and the cover and the reservoir may be assembled employing a seal able to withstand high pressure and temperature such that a high velocity jet and droplet stream can be generated. Therein, the cover may be designed to withstand pressures up to 5000 bar and/or temperatures up to 4000° C.

In certain embodiments, the dispensing device comprises a detachable cover which is adapted to seal said reservoir from the environment, wherein said cover is able to withstand pressures up to 5000 bar and/or temperatures up to 4000° C.

In certain embodiments, the resonant structure comprises a backing mass attachment which is coupled to the actuation means, wherein particularly the backing mass attachment is positioned outside of the reservoir. For example, the backing mass attachment can be attached to the piston of the dispensing device with one or several bolts or other means thus compressing the electro-actuatable element in order to ensure an efficient transmission of acoustic energy into the piston structure. The backing mass attachment can consist of two or more parts, one of which can be fixed such that no rotary motion or torsional forces are imposed onto the electro-actuatable element, particularly in the case of a single bolt being used for attachment of the backing mass attachment to the piston or for attachment of the backing mass attachment to the cover of the droplet dispensing device.

According to another embodiment of the invention, the backing mass attachment is adapted to apply a mechanical pre-stress to the electro-actuatable element, Therein for example, the backing mass attachment can be attached to the piston with one or several bolts.

In certain embodiments, the actuation means is positioned outside of the reservoir.

In certain embodiments, the droplet dispensing device comprises a filter for filtering the liquid, wherein the filter is positioned upstream of the outlet, particularly upstream of the nozzle orifice, and wherein the filter is coupled to the resonant structure, particularly to the piston. Therein, the term 'upstream' refers to the direction of the droplets being dispersed from the outlet.

In particular, the filter is mechanically connected to the resonant structure, particularly to the piston. The filter serves to prevent the clogging of the nozzle orifice by dirt particles, and removing dirt particles also contributes to the generation of a monodisperse stream of droplets. In case the filter is mechanically coupled to the resonant structure, the filter vibrates when the resonant structure is excited, and the filter contributes to the resonance frequency of the resonant structure. Incorporating the filter in the resonant structure is advantageous because the filter contributes to the generation of high pressure waves in the liquid medium.

According to certain embodiments, the filter is attached to a part of the droplet dispensing device by means of a flexible mechanical connection.

In certain embodiments, the piston is mechanically coupled to the filter. This reduces the damping effect of the filter on the excitation signal and increases the transmission of the excitation signal into the liquid medium below the filter and thus achieves a higher excitation strength acting on the jet emanating from the nozzle and/or reduces the damping effect of the filter on the induced pressure waves and increases the transmission thereof into the liquid medium below the filter.

In certain embodiments, the filter is flexibly connected to the resonant structure. In this case, the filter is not mechanically coupled to the resonant structure, in order to allow it to vibrate freely and reduce any potential damping effects on the excitation signal. For example, the filter can be flexibly attached to the resonant structure via a corrugated thin metal plate.

In certain embodiments, the filter comprises a porous material or consists of a porous material, wherein the porous material comprises pore sizes between 1 nm and 20 μm, particularly 0.05 μm to 20 μm.

Furthermore, the filter may comprise a chemically inert material, particularly tungsten, silicon nitride, or a ceramic.

In particular, the filter can be adapted such that it can be easily replaced and exchanged.

In certain embodiments, the filter and/or the outlet nozzle is produced out of a material, which is inert to chemical reaction with molten tin, particularly tungsten, silicon nitride or a ceramic.

In certain embodiments, the droplet dispensing device comprises a control device adapted to determine the resonance frequency and change the excitation frequency according to the determined resonance frequency.

In certain embodiments, the droplet dispensing device comprises a cooling device, which is adapted to cool, particularly actively cool, the actuation means, particularly the electro-actuatable element.

A second aspect of the invention relates to a light source for providing UV and/or X-ray light, comprising a droplet dispensing device according to the first aspect of the invention, which is adapted to provide droplets of a liquid medium, a laser source, which is adapted to provide a laser beam and direct the laser beam onto at least one of the droplets, wherein the laser beam is adapted to excite atoms and/or molecules comprised in the droplets, such that UV and/or X-ray light is emitted by the atoms and/or molecules.

A third aspect of the invention relates to a method for providing droplets, particularly a monodisperse stream of droplets, by means of a droplet dispensing device according to the first aspect of the invention, wherein the method comprises the steps of providing the droplet dispensing device according to the first aspect of the invention, providing a liquid medium in the reservoir of the droplet dispensing device, generating a mechanical oscillation at an excitation frequency by means of the actuation means, wherein the excitation frequency is sufficiently close to a resonance frequency of the resonant structure, such that resonance occurs, transmitting the mechanical oscillation to the liquid medium at the excitation frequency by means of the resonant structure, and forming the droplets from the liquid medium by means of the transmitted mechanical oscillation.

In certain embodiments, the method comprises the steps of:

providing a liquid medium, providing an acoustically resonant structure comprising an actuation means, wherein the resonant structure has a resonance frequency, providing a plurality of droplets of the liquid medium by transmitting a periodic mechanical force to the liquid medium by means of the actuation means at an excitation frequency, particularly in the range of 1 kHz to 1000 kHz, more particularly 1 kHz to 200 kHz, wherein the resonance frequency and the excitation frequency are sufficiently close to each other such that resonance occurs, generating a stream of the droplets.

Therein, the resonant structure may comprise a piston, wherein the tip of the piston is in direct contact with the liquid medium. In particular, the piston is actuated by the electro-actuatable element.

In certain embodiments, the excitation frequency is in the range of 1 kHz to 1000 kHz, particularly 1 kHz to 200 kHz.

According to another embodiment of the invention, the liquid medium is a molten metal or metal alloy, particularly aluminium, chromium, copper, nickel-chromium based alloys (such as alloys commercially available under the name "Inconel"), iron, magnesium, molybdenum, nickel, platinum, steel, tin, or titanium, more particularly tin. In particular, the metal has a melting point below the melting point of the material (e.g. tungsten) out of which the reservoir, piston, filter and nozzle is manufactured. In certain embodiments, the liquid medium is molten tin or a solution comprising tin.

In certain embodiments, the liquid medium is molten tin or a solution comprising tin.

In certain embodiments, the resonant structure comprises at least a part of the liquid medium. According to certain embodiments, the resonant structure comprises the liquid medium in the reservoir and/or the outlet.

In certain embodiments, the resonance frequency is determined, wherein the excitation frequency is changed according to the determined resonance frequency. Therein, in particular, the characteristic shape of the phase and impedance exhibited while the resonant structure is frequency swept through one or more resonance frequencies is used to track the resonance frequency over time and adapt the excitation frequency accordingly in order to ensure an operation of the dispenser at resonance at all times. For example, the resonant frequency might change due to a changing fluid level or a changing temperature of the electro-actuatable element over time, which can also be caused by a changing fluid level In the reservoir.

In certain embodiments, a voltage signal is applied to the electro-actuatable element, such that at least a part of the resonant structure, particularly at least part of the piston, more particularly the piston tip, vibrates. For example, the voltage signal may exhibit a sinusoidal waveform, a square waveform, a rectangular waveform, a sawtooth waveform or a peaked-nonsinusoidal waveform, particularly a sinusoidal waveform. In particular, the voltage signal may be amplitude modulated or frequency modulated.

In certain embodiments, pressure waves are induced in the liquid medium that lead to a breakup of the liquid medium into a stream of droplets, particularly monodisperse droplets.

In certain embodiments, the electro-actuatable element is cooled.

According to a further embodiment, the electro-actuatable element is compressed by means of the backing mass attachment. Therein, for example, the backing mass attachment may be mechanically connected to the electro-actuatable element, such that a compression force is applied to the electro-actuatable element by means of the backing mass attachment.

According to another embodiment, the electro-actuatable element is exposed to a frequency or amplitude modulated electric voltage in order to achieve droplet merging. Furthermore, the applied voltage signal can exhibit a sinusoidal waveform, a square waveform, a rectangular waveform, a sawtooth waveform or a peaked-nonsinusoidal waveform.

The invention is directed to a droplet dispensing device capable of producing a monodisperse micrometre sized droplet stream even for high temperature liquids such as molten metals and for operation conditions at low non-dimensional wavenumbers including values smaller than 0.3 which can be used for various purposes and in various applications. One particular application of the invention is the generation of micrometre-sized droplets as target material for EUV light sources such as the one shown in FIG. 1, the material being capable of radiating in the target wavelength window in the EUV region when irradiated by a high power laser and excited into a higher energy state. Further applications are related to the 3D printing of metals (including those with high melting points), where the generation of uniformly sized droplets is important.

Figure 1:
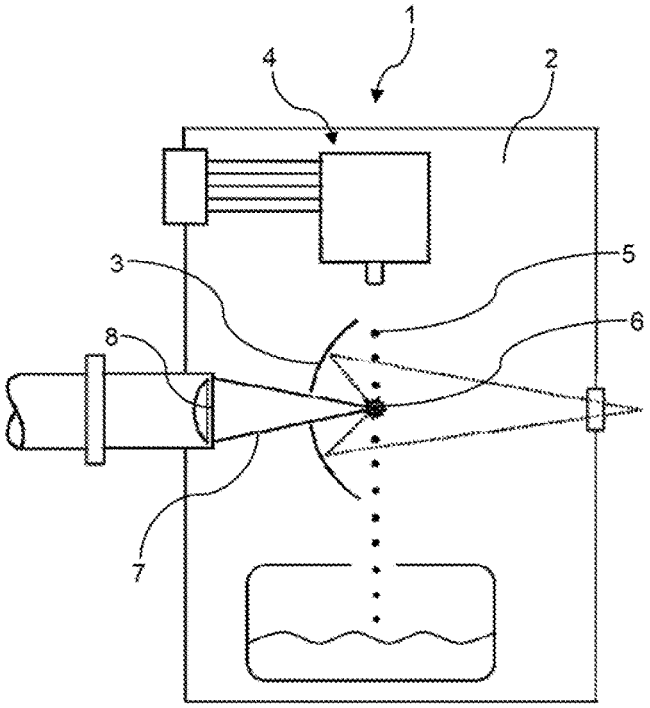
FIG. 1 shows a simplified sectional view of a light source including an embodiment of the droplet dispensing device according to the invention.
Figure 2:
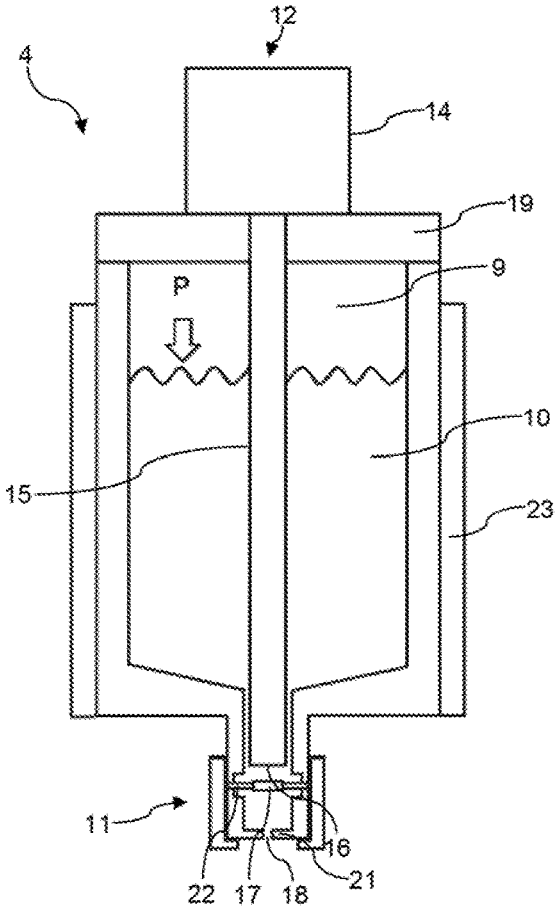
FIG. 2 shows a schematic sectional view of an embodiment of the droplet dispensing device according to the invention.

FIG. 1 shows a light source 1 comprising a vacuum chamber 2 containing collector optics 3 for extreme-ultraviolet or soft X-ray light and a droplet dispensing device 4 according to the present invention, a possible embodiment of which is shown in FIG. 2 for the continuous delivery of target material 5 to the irradiation site 6. The target material 5 gets irradiated by a high power laser beam 7 at the irradiation site 6, the focus point of the laser, and forms an EUV light emitting plasma. The laser beam 7 is brought into the vacuum chamber 2 through a flanged window 8 and its temporal and spatial characteristics should be such that the conversion efficiency (ratio of emitted EUV light energy to laser energy) is maximized with respect to the size and location of the target material.

The droplet dispensing device 4, a possible embodiment of which is shown in FIG. 2 delivers the target material 5 in form of a continuous droplet stream to the irradiation site 6. The droplets may be of any material suitable for the generation of radiation upon irradiation by a high power laser, including metals such as Sn, Li, In, Ga, Na, K, Mg, Ca, Hg, Cd, Se, Gd, Tb, alloys of these materials such as SnPb, SnIn, SnZnIn, SnAg, liquid non-metals such as Br or liquefied gases such as Xe, $N_2$, and Ar as well as suspensions of a target material in a solution, e.g. in water or alcohol. Droplet sizes can be in the range of 5 μm to 100 μm in order to reduce the amount of detrimental debris as a side product of the irradiation of the droplet and the plasma formation. The delivery of the target material 5 may be at a constant frequency and uniform droplet target size.

FIG. 2 depicts a possible embodiment of the droplet dispensing device 4 according to the invention in a cross-sectional view. The device 4 comprises a reservoir 9 for receiving a liquid medium 10, an outlet nozzle assembly 11 in fluid and acoustic communication with the reservoir 9 and an oscillating actuation means 12 for producing pressure waves in the liquid medium 10, in particular at the outlet nozzle assembly 11, such that a part of the liquid medium 10 exits the outlet nozzle assembly 11 in a sequence of droplets. Both the reservoir 9 and the outlet nozzle assembly 11 may be heated using a heater 23 (electrical, inductive infrared or other).

The actuation means 12 comprises a backing mass attachment and electro-actuatable element 14, and a piston 15, the tip 16 of which is immersed in the liquid medium 10. The electro-actuatable element may be actively cooled. A filter 17 may be placed upstream of or in the outlet nozzle assembly 11 in order to avoid clogging of the outlet nozzle assembly 11. The outlet nozzle assembly 11 may have a micromachined nozzle orifice 18. The droplet dispensing device 4 (which may comprise a casing or cartridge of the reservoir 9) may be replaceable (i.e. removable from and reinsertable into the light source 1) and refillable and connected to a backpressure of an inert gas in order to form a jet emanating from the nozzle orifice 18. A typical gas may be gas inert to any chemical reactions with the target material such as Ar, N, Kr or He.

Figure 3:
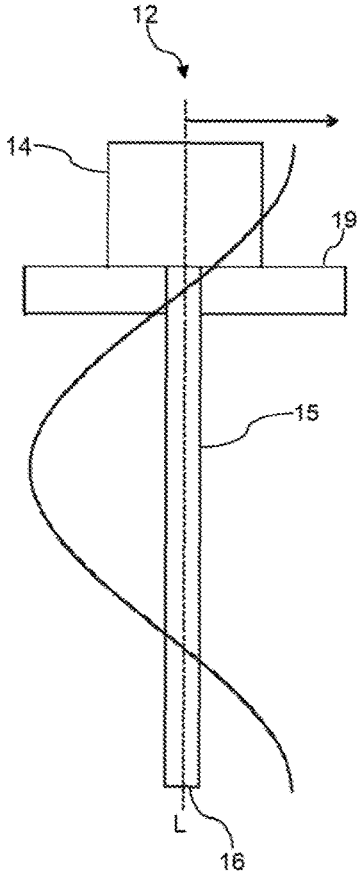
FIG. 3 shows a sectional view of a part of the droplet dispensing device of the present invention comprising a piston according to a first embodiment.

FIG. 3 shows a part of the droplet dispensing device 4 comprising the actuation means 12 consisting of an electro-actuatable element, being attached to the cover of the reservoir 9, a backing mass attachment as well as a piston 15. The displacement along the longitudinal axis L is shown for operation at the resonant frequency.

Figure 5:
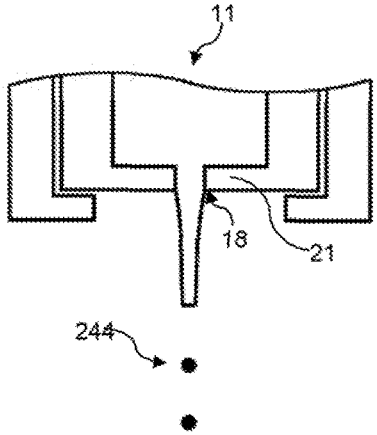
FIG. 5 shows the formation of a jet emanating from the nozzle orifice and the break-up of the jet into a regular stream of droplets.

FIG. 3 further shows a piston 15, which is actuated by an electro-actuatable element being mounted in-between the backing mass attachment and the piston 15. The backing mass attachment and electro-actuatable element 14 and the piston 15 are all positioned on the same longitudinal axis L. The backing mass attachment and electro-actuatable element 14 can either be positioned on the outside or inside of the reservoir 9. The free piston tip 16 is immersed in the liquid medium 10 just upstream of the outlet nozzle assembly 11. The actuation means 12 is actuated by applying an electric signal to the electro-actuatable element and generates acoustic waves inside the piston 15 and causing the piston 15 and its tip 16 to vibrate. This in turn induces pressure waves in the liquid medium 10 and can also lead to periodic displacements of the liquid medium 10 both of which can propagate to the outlet of the nozzle orifice 18. Both of these effects combined or alone can lead to the generation of a stable breakup of the jet emanating from the outlet nozzle assembly 11 resulting in a monodisperse droplet stream as shown in FIG. 5.

Figure 4:
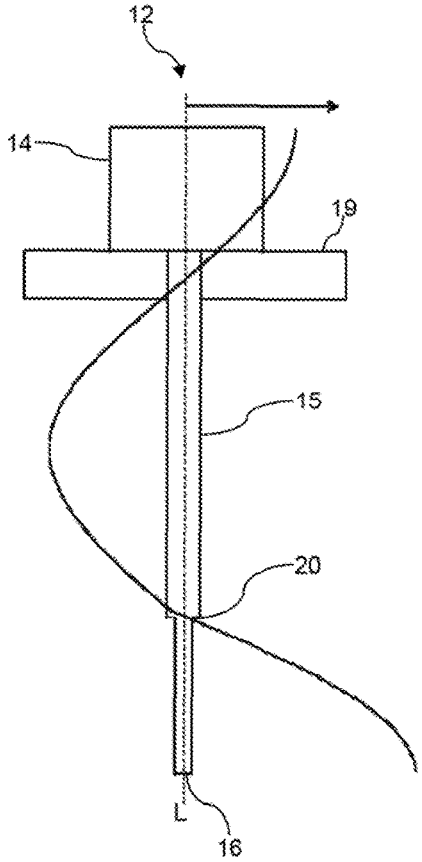
FIG. 4 shows a sectional view of a part of the droplet dispensing device of the invention comprising a piston according to a second embodiment with a diameter step change of the piston at the lower nodal point and a higher longitudinal displacement of the piston tip.

The length scales and material choices of all components of the actuation means 12 (backing mass attachment and electro-actuatable element 14, piston 15) have to be carefully chosen and calculated such that at the design frequency a standing wave is formed in the actuation means 12 making it behave as a resonant structure and the end of the backing mass attachment as well as the piston tip 16 form a region of maximum displacement as shown in FIG. 3 and in FIG. 4. At the same time the region where the piston 15 and the electro-actuatable element is connected to the cover 19 forms a region of minimum displacement. The piston 15 is attached to the cover 19 ideally by means of laser welding in order to achieve high precision of the combined unit. Alternatively the piston 15 and cover 19 can also be machined out of one uniform piece. The connection of the actuation means 12 to the cover 19 and the remaining structure of the droplet dispensing device 4 at a region of minimum longitudinal displacement ensures a minimum amount of vibrations being transferred into the remaining structure of the droplet dispensing device 4 which might also create acoustic pressure waves in the liquid medium 10. This ensures that as high a proportion as possible of the pressure waves induced in the liquid medium 10 is created through the piston tip 16 only such that a highly clear and uniform excitation signal is generated for the break-up of the jet. This is crucial for achieving a stable break-up and reducing undesired interference of noise signals.

As shown in FIG. 4, the piston 15 can exhibit a diameter step change 20 at the lower nodal region associated with minimum longitudinal displacement and maximum stress. This diameter step change 20 of the piston 15 leads to an amplification of the vibrations by a factor proportionate to the change in cross sectional area of the piston 15. As the stress is transferred onto a smaller cross section the associated force and velocity and thus displacement is amplified by the factor. This gain ratio of the setup (here the change of the cross-sectional areas at the step) can be used to amplify the acoustic vibrations in the piston 15 induced by the electro-actuatable element. Thereby the piston tip 16 velocity and displacement can be increased and accordingly the generated pressure strength. The gain ratio has to be calculated in accordance with the acoustic load imposed by the liquid medium 10 in order to prevent suppression of the resonance modes for too high gain ratios.

The outlet nozzle assembly 11 and in particular the liquid medium 10 inside it can also form part of the resonant structure in order to further amplify the strength of the pressure excitation at the nozzle orifice 18. Effectively, the distance between the piston tip 16 and the nozzle orifice 18 has to be carefully calculated in consideration of the acoustic impedance of the characteristics of the liquid medium 10 in order to achieve the formation of a standing wave in the outlet nozzle assembly 11.

Figure 6:
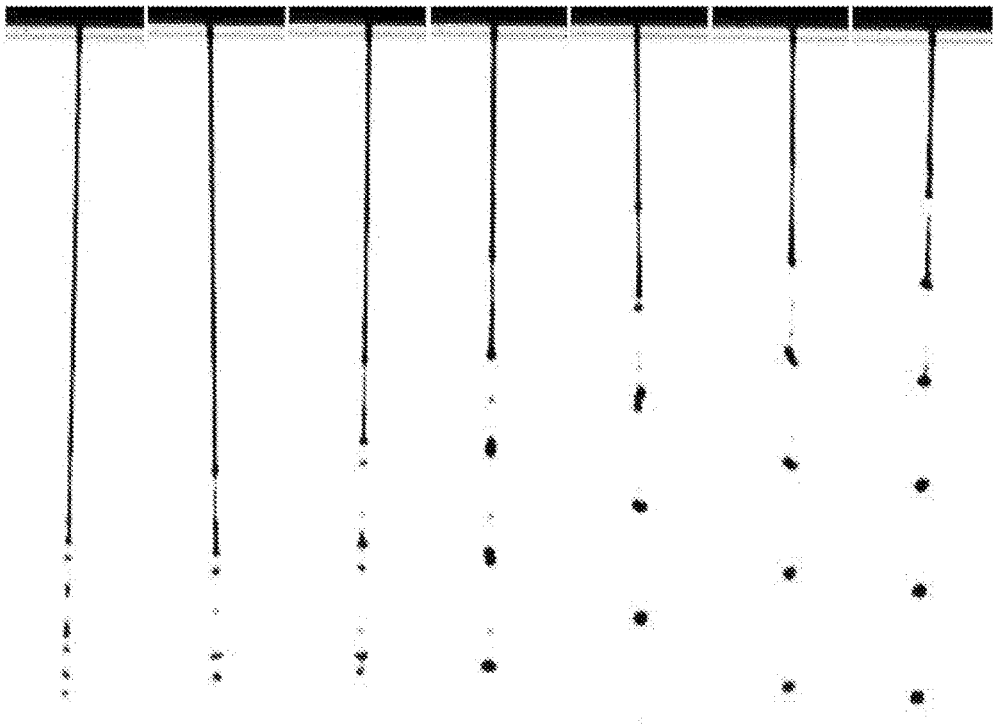
FIG. 6: shows the effect of increasing the excitation voltage applied to the electro-actuatable element from left to right (peak-to-peak voltages: 0.5V, 1V, 2V, 4V, 6V, 8V, 10V) on the droplet break-up resulting in a stable droplet stream towards higher excitation voltages.

With the presented invention high excitation pressure waves in the order of several bars can be achieved. The generation of high amplitude pressure waves can be beneficial for the stable generation of droplets at low non-dimensional wavenumbers well below the value associated with the maximum growth rate. FIG. 6 shows high-resolution images of the break up region of the jet emanating the nozzle orifice 18 with increasing levels of the excitation strength (peak-to-peak voltages: 0.5V, 1V, 2V, 4V, 6V, 8V, 10V, increasing from left to right) obtained with the invention presented in this patent application. The importance of the increased excitation amplitude for the generation of a micrometer sized droplet stream with high temporal stability can be clearly seen.

The operation of the invention is, however, not only limited to the operation of the system at resonance frequency or limited to the operation of the system in which the cover 19 forms a point of zero displacement.

Figure 7:
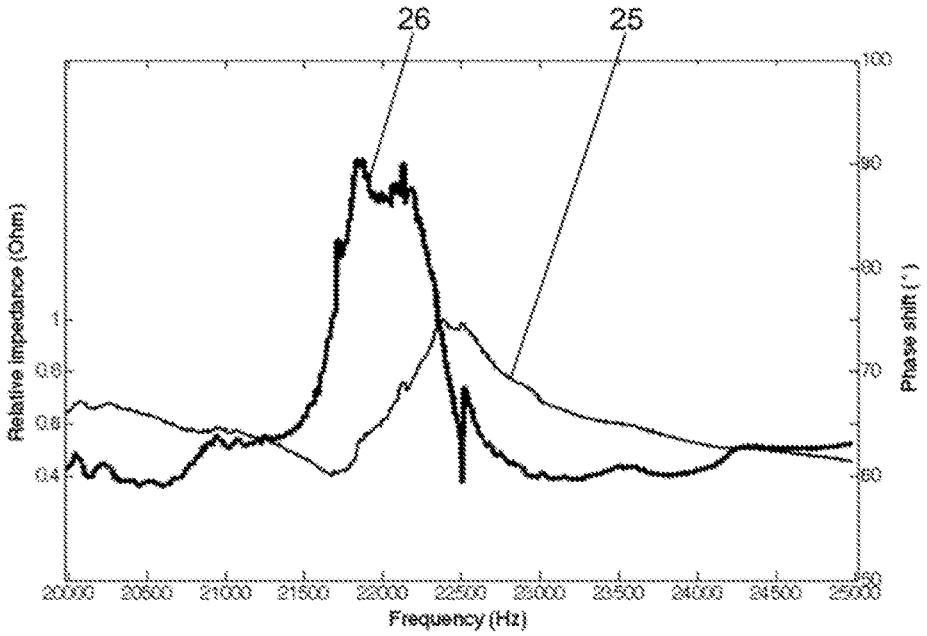
FIG. 7: shows resonance curves illustrating the characteristic shapes of the electric impedance and phase between voltage and current signal applied to the electro-actuatable element exhibited as the dispenser is frequency swept through resonance when the piston is immersed in molten tin.

When the excitation frequency of the droplet dispensing device 4 is changed, the electric circuit exhibits a characteristic change in both electric impedance and phase as shown in FIG. 7, depicting the frequency response of the actuation means according to the present invention with the piston tip immersed in molten tin. Therein, a first graph 25 (thin line) illustrates the relative impedance values in Ohm at the respective excitation frequencies and a second graph 26 (thick line) illustrates the corresponding phase shift values in degrees (°). This characteristic shape can be used in a feedback control system to adapt the excitation frequency to account for any changes of the resonant frequency. These might occur due to increased self-heating effects of the electro-actuatable element over time or a changing liquid medium 10 level changing the heat load the electro-actuatable element is exposed to and thus also its temperature, which changes the electro-actuatable element impedance (in case of a piezoelectric actuator) and thus the resonant frequency of the entire system.

The electro-actuatable element can be placed outside of the high-temperature and high-pressure reservoir 9. This is particularly made possible through the resonance structure, in which the acoustic vibrations generated by the electro-actuatable element are effectively transmitted to the piston tip 16 while the region where the resonant structure is attached to the cover does not exhibit significant longitudinal displacement. Various cooling means can be employed on the outside of the high pressure and high temperature vessel to actively and directly cool the electro-actuatable element. One method is for example based on impingement cooling. For impingement cooling the cooling means comprises a high pressure zone separated from the electro-actuatable element by a plate equipped with holes through which the air flows from the high pressure zone into the low pressure zone and impinges directly onto the electro-actuatable element. This allows highly effective cooling of the actuator and thus ensures its effective operation (other means of cooling can also be based on a liquid cooling fluid, e.g. an electrically non-conductive cooling fluid). For piezoelectric actuators this is particularly important as a depolarization of the piezoelectric material can occur when temperatures above half the Curie temperature are exceeded (for common piezoelectric materials this corresponds to approximately 150° C.)

As shown in FIG. 5, the outlet nozzle assembly 11 includes the nozzle casing 21 with a micro-machined nozzle orifice 18 as well as a porous filter 17 placed upstream of the nozzle casing 21 preventing the clogging of the micrometer sized nozzle orifice 18 due to dirt particles. The porous filter 17 and nozzle casing 21 may be made out of or coated with materials inert to chemical reactions with the target material such as, tungsten, silicon nitride, diamond, sapphire, aluminium oxide, silica or stainless steel. The micro-machining process for the creation of the micrometre-sized nozzle orifice 18 should give low geometric tolerances on the quality of the nozzle orifice 18 in particular with respect to the surface roughness of the inner surface of the orifice channel. The micro-machining process can include but is not restricted to laser-drilling, electrical discharge machining and etching. A smooth surface on the inside of the micrometer-sized nozzle orifice 18 is important as surface defects can induce turbulences acting as undesired excitation sources on the jet break-up process. The nozzle channel may have various geometric forms including a tapered channel, a straight channel or a streamlined channel. Both filter 17 and nozzle can be easily replaced and exchanged.

The porous filter 17 may be made of a sintered material and have pore sizes in the range of 0.05 μm to 20 μm. The porous filter 17 may be equipped with a sealing ring 22 as shown in FIG. 2, which provides a high pressure suitable sealing solution with respect to both the nozzle casing 21 as well as to the material reservoir 9. Also, the porous filter 17 and the sealing ring 22 might be connected in a flexible manner such as through the use of a corrugated sheet.

The filter 17 can be mechanically coupled to the piston tip 16 in order to reduce the damping effect of the porous filter 17 on the induced pressure waves and increase the transmission thereof into the liquid medium 10 below the filter 17. Further, the fitter 17 may be flexibly attached to the structure of the reservoir 9 and outlet nozzle assembly 11, e.g. by the use of corrugated flexible connection between the sealing ring 22 of the filter 17 and the outlet nozzle assembly 11 and reservoir 9.

The piston 15 and the reservoir 9 can be manufactured out of or coated with materials inert to chemical reactions with the target material such as, tungsten, silicon nitride, diamond, sapphire, aluminium oxide, silica or stainless steel.

The droplet dispensing device 4 according to the invention can be operated with various liquid mediums including high temperature molten metals (e.g. aluminium, chromium, copper, nickel-chromium based alloys (such as alloys commercially available under the name "Inconel"), iron, magnesium, molybdenum, nickel, platinum, steel, tin, titanium and many more including alloys thereof) that have a melting point below the one of the material out of which the droplet dispensing device 4 is made (e.g tungsten). The droplet dispensing device according to the invention is particularly suited for such high temperature metals, as the electro-actuatable element is positioned outside of the high temperature and high pressure reservoir 9, where it can be effectively cooled.

In the presented invention a pre-stress can be applied to the electro-actuatable element via a bolt that goes through the hollow cylindrical electro-actuatable element and is threaded into the piston 15 structure. Other forms and shapes of an electro-actuatable element can be used, such as a cuboid, including other means to apply the pre-stress and connect the backing mass rigidly to the electro-actuatable element. In case of a hollow cylindrical electro-actuatable element a piece between the backing mass attachment with the integrated bolt and the electro-actuatable element itself can be prevented from rotary motion, and thereby any detrimental exertion of torsion on the electro-actuatable element can be prevented.

The cover 19 of the reservoir 9 is detachable from the container of the reservoir 9 and the cover 19 and the reservoir 9 are assembled employing a seal suitable to withstand high pressures and temperatures. Such a sealing ring can for example be made of a softer metal than the cover 19 and the reservoir 9 container and a mechanical seal can be achieved by mechanically deforming the sealing ring with knive edges manufactured in both the cover 19 and the reservoir 9 container. Many other methods can be employed, however, to achieve such a high temperature and high pressure resistant sealing between the cover 19 and the reservoir 9.

The electric voltage signal can exhibit various waveforms, including a sinusoidal waveform, a square waveform, a rectangular waveform, a sawtooth waveform or a peaked-nonsinusoidal waveform.

The applied electric signal can also be amplitude or frequency modulated in order to achieve 'droplet merging'. Droplet merging refers to the phenomenon, in which multiple droplets are generated per modulation period, which exhibit relative velocity components towards each other such that after a certain time of flight and distance these droplets merge together and thus form one droplet per modulation period. Droplet merging, next to methods to increase the excitation amplitude, further allows reducing the lower limit of stable droplet formation In terms of the non-dimensional wavenumber. This is due to the initial droplet formation occurring at a higher non-dimensional wavenumber, while the eventual merging of the droplets generated per modulation period, leads to a droplet stream corresponding to a lower non-dimensional wavenumber.

LIST OF REFERENCE SIGNS

1 Light source
2 Vacuum chamber
3 Collector optics
4 Droplet dispensing device
5 Target material
6 Irradiation site
7 Laser beam
8 Flanged window
9 Reservoir
10 Liquid medium
11 Outlet nozzle assembly
12 Actuation means
14 Backing mass attachment and electro-actuatable element
15 Piston
16 Tip
17 Filter
18 Nozzle orifice
19 Cover
20 Diameter step change
21 Nozzle casing
22 Sealing ring
23 Heater
24 Droplet stream
25 First graph
26 Second graph
L Longitudinal axis

The invention claimed is:

1. Droplet dispensing device (4) comprising a reservoir (9) for containing a liquid medium (10), wherein the droplet dispensing device (4) comprises an outlet (11) for dispensing droplets of said liquid medium (10) from said reservoir (9), an actuation means (12) for generating and transmitting a mechanical oscillation at an excitation frequency, wherein the droplet dispensing device (4) comprises a resonant structure coupled to said actuation means (12), wherein said resonant structure has a resonance frequency which is sufficiently close to said excitation frequency, such that resonance occurs when the mechanical oscillation is transmitted from the actuation means (12) to the resonant structure at said excitation frequency, and wherein said actuation means and/or said resonant structure comprises a piston (15), wherein the piston (15) comprises a tip (16), which is immersed or immersible in said liquid medium (10), wherein said piston (15) is adapted to transmit said mechanical oscillation from said actuation means (12) to said liquid medium (10), such that droplets are formed from said liquid medium (10), characterized in that said piston (15) comprises at least a first section having a first cross-sectional area perpendicular to a longitudinal axis (L), along which said piston (15) extends, and a second section having a second cross-sectional area, wherein the second cross-sectional area is smaller than the first cross-sectional area, and wherein the second section is adapted to contact the liquid medium (10), wherein the piston (15) comprises a step change (20) in cross-sectional area, such that the displacement of the piston (15) can be amplified.

2. Droplet dispensing device (4) according to claim 1, characterized in that the excitation frequency is in the range of 1 kHz to 1000 kHz, particularly 1 kHz to 200 kHz.

3. Droplet dispensing device (4) according to claim 1, characterized in that said actuation means (12) comprises an electro-actuatable element, particularly a piezoelectric element, which is adapted to transmit said mechanical oscillation to said piston (15).

4. Droplet dispensing device (4) according to claim 1, characterized in that said piston (15) is mechanically connected to a cover (19) of said reservoir (9) or to an inside wall of said reservoir (9), wherein the connection between said piston (15) and said cover (19) or said inside wall forms a region of smaller displacement than the displacement of the tip (16) of said piston (15).

5. Droplet dispensing device (4) according to claim 1, characterized in that said resonant structure: comprises a backing mass attachment wherein said backing mass attachment is coupled to said actuation means (12), wherein particularly said hacking mass attachment is positioned outside of said reservoir (9).

6. Droplet dispensing device (4) according to claim 1, characterized in that said actuation means (12) is positioned outside of said reservoir (9).

7. Droplet dispensing device (4) according to claim 1, characterized in that said droplet dispensing device (4) comprises a filter (17) for filtering said liquid, wherein said filter (17) is positioned upstream of said outlet, and wherein said filter (17) is coupled to said resonant structure.

8. Droplet dispensing device (4) according to claim 7, characterized in that said filter (17) is flexibly connected to said resonant structure.

9. Droplet dispensing device (4) according to claim 1, characterized in that said, resonant structure comprises said reservoir (9).

10. Light source (1) for providing UV and/or X-ray light, comprising a droplet dispensing device (4) according to claim 1, which is adapted to provide droplets of a liquid medium (10), a laser source, wherein the laser source is adapted to provide a laser beam (6), and direct said laser beam (6) onto at least one of said droplets, wherein said laser beam (6) is adapted to excite atoms and/or molecules comprised in said droplets, such that UV and/or X-ray light is emitted by said atoms and/or molecules.

11. Method for providing, droplets, comprising the steps of:

providing a droplet dispensing device (4 according to claim 1, providing a liquid medium (10) in said reservoir (9) of said droplet dispensing device (4), generating a mechanical oscillation at an excitation frequency by means of said actuation means (12), wherein the excitation frequency is sufficiently close to a resonance frequency of said resonant structure, such that resonance occurs, transmitting said mechanical oscillation to said liquid medium (10) at said excitation frequency by means of said resonant structure, forming said droplets from said liquid medium by means of said transmitted mechanical oscillation.

12. Method for providing droplets according to claim 11, wherein the excitation frequency is in the range of 1 kHz to 1000 kHz, particularly 1 kHz to 200 kHz.

13. Method for providing droplets according to claim 11, wherein said resonant structure comprises said liquid medium (10) in said reservoir (9) and/or said outlet (11).

14. Method for providing droplets according to claim 11, wherein said resonance frequency is determined, and wherein said excitation frequency is changed according to the determined resonance frequency.

* * * * *